US006503053B2

(12) United States Patent
Huebner

(10) Patent No.: US 6,503,053 B2
(45) Date of Patent: Jan. 7, 2003

(54) BLADE WITH OPTIMIZED VIBRATION BEHAVIOR

(75) Inventor: Norbert Huebner, Dachau (DE)

(73) Assignee: MTU Motoren-und Turbinen München GmbH, München (DE)

( * ) Notice: Subject to any disclaimer, the term of this patent is extended or adjusted under 35 U.S.C. 154(b) by 7 days.

(21) Appl. No.: 09/728,129

(22) Filed: Nov. 30, 2000

(65) Prior Publication Data

US 2001/0002235 A1 May 31, 2001

(30) Foreign Application Priority Data

Nov. 30, 1999 (DE) ..... 199 57 718

(51) Int. Cl.[7] ..... F01D 9/04
(52) U.S. Cl. ..... 415/191; 415/915
(58) Field of Search ..... 415/915, 200; 416/500, 236 A, 236 R, 190, 191

(56) References Cited

U.S. PATENT DOCUMENTS

| | | | | |
|---|---|---|---|---|
| 3,012,709 A | | 12/1961 | Schnell | |
| 3,193,185 A | * | 7/1965 | Erwin et al. | 416/193 R |
| 3,706,512 A | | 12/1972 | Strelshik | 416/236 R |
| 4,108,573 A | | 8/1978 | Wagner | 416/236 A |
| 4,128,363 A | | 12/1978 | Fujikake et al. | 416/236 A |
| 4,257,741 A | | 3/1981 | Betts et al. | 416/196 R |
| 4,720,239 A | * | 1/1988 | Owczarek | 416/236 R |
| 5,286,168 A | * | 2/1994 | Smith | 416/193 A |

FOREIGN PATENT DOCUMENTS

| | | |
|---|---|---|
| DE | 762 991 | 5/1943 |
| DE | 29 30 465 | 5/1980 |
| GB | 840543 | 7/1960 |
| GB | 996041 | 6/1965 |
| GB | 1366924 | 9/1974 |
| GB | 2090339 | 7/1982 |

* cited by examiner

*Primary Examiner*—Edward K. Look
*Assistant Examiner*—Kimya N McCoy
(74) *Attorney, Agent, or Firm*—Schiff Hardin & Waite

(57) ABSTRACT

A blade with optimized vibration behavior for turbomachinery components in an axial-type construction having a solid, thin and elongated blade body, the blade, at a distance from both a radially inner blade body end and a radially outer blade body end, having at least one plate-like rib which is disposed in an upright position on the blade body surface and is oriented in a neutral manner with regard to the flow and is also integrally connected to the blade body on one of the suction and pressure sides of the blade.

4 Claims, 1 Drawing Sheet

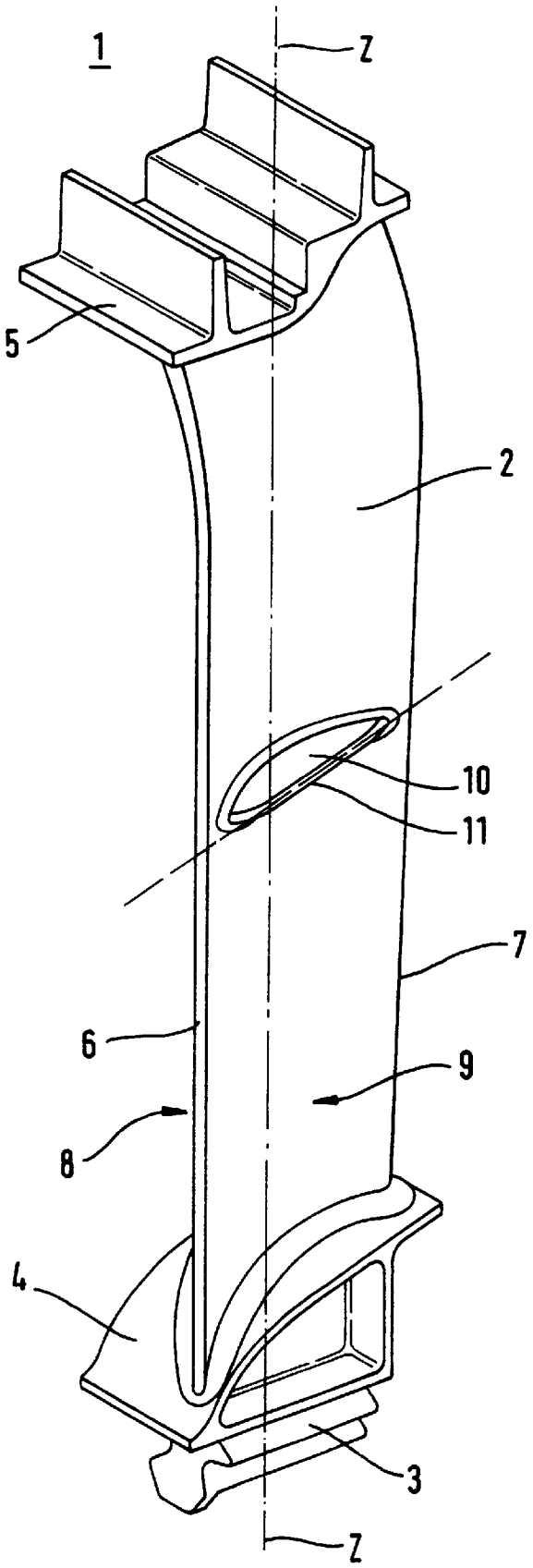
1
Z
5
2
10
11
7
6
9
8
4
3
Z

BLADE WITH OPTIMIZED VIBRATION BEHAVIOR

BACKGROUND OF THE INVENTION

The present invention is directed to a blade with optimized vibration behavior for turbomachinery components in an axial type of construction. The axial-type construction having moving or guide blades for the low-pressure turbine region of a gas turbine and having solid, thinly-profiled blade bodies which are elongated in the direction of the stacking axis, which is a radial direction.

In the case of solid, thinly-profiled and radially long low-pressure compressor moving blades, such as fan blades, it is known to influence the vibration behavior of the blades in the cascade by a mutual contact. In this respect, see U.S. Pat. No. 4,257,741, whose disclosure is incorporated herein by reference thereto and from which German 29 30 465 claims priority. For this purpose, each of the blade bodies on the pressure side and the suction side has a projection pointing in the circumferential direction with a defined wear-resistant contact surface. Since the blades in the cascade virtually never vibrate synchronously, i.e., uniformly and in phase, they are mutually dampened by impact and frictional actions at the contact surfaces of these projections. The projections are often referred to as "snubbers".

U.S. Pat. No. 4,128,363, whose disclosure is incorporated herein by reference thereto, relates to an arrangement of rib-like flow-guide elements on the surfaces of axial compressor blades. The task of the "ribs" on the blades is to give the flow, which is, at first, in an axial direction, an additional specific radial component. These blades are intended to be used mainly as radiator fans of a motor vehicle. The fluidic effect, which can be achieved with this design, is an increase in the diameter of the cross-section of the flow emerging from the fan. At any rate, the ribs have an exclusively fluidic function.

SUMMARY OF THE INVENTION

In a simple manner from the design point of view, the object of the present invention is to modify and, thus, optimize the vibration behavior of solid, thinly-profiled and elongated blades for turbomachinery components in an axial type of construction, with the blade weight and the flow properties remaining largely unchanged.

This object is achieved in an improvement in a blade with optimum vibration behavior of a turbomachinery component as either a moving or guide blade for the low-pressure turbine region of gas turbines having a solid, thinly-profiled blade body which is elongated in the direction of a stacking axis, which is a radial axis. The improvement is that, at a radial distance from both the radially inner blade body end, which is adjacent the platform, and the radially outer blade body end, which is the shroud band, at least one plate-like rib is disposed in an upright position on a surface of the blade body and is oriented in a neutral manner with regard to the flow, and without a relevant angle of incidence to the local flow path, and is integrally connected to the blade body on one of the suction and pressure sides.

The invention proposes to integrate at least one rib which is neutral with regard to the flow in the profiled blade body. This rib, at first, locally increases the planar moment of inertia of the blade body, as a result of which, in particular, the flexural strength about the radial stacking axis or about axes parallel to the latter is considerably improved. However, the local change has an effect on the vibration behavior of the entire blade, so that the mode of vibration and resonant frequency can be specifically influenced and optimized. The increase in the weight and the increase in the flow resistance are negligible in relation to the disadvantages and risks of a blade vibrating in resonance. Since the ribs according to the invention do not touch the neighboring blades, there is neither friction nor wear, and also no impact effects.

Preferably, the blade profile is arched to a more pronounced extent so that at least one rib is arranged on the concave side of the blade profile and a free edge of this rib runs over most of its length approximately in a rectilinear connection between a leading edge and a trailing edge of the blade profile.

The blades can be a cast or a forged design. The at least one rib corresponds to an integral cast or forged contour produced with the blade body.

Other advantages and features of the invention will be readily apparent from the following description of the preferred embodiments, the drawing and claims.

BRIEF DESCRIPTION OF THE DRAWINGS

The FIGURE is a perspective view of a low-pressure turbine moving blade for a gas turbine engine in accordance with the present invention.

DESCRIPTION OF THE PREFERRED EMBODIMENT

The principles of the present invention are particularly useful when incorporated in a blade 1 illustrated in the Figure, which has a large extent in the direction of its radial stacking axis Z. The relatively pronounced concavity of a pressure side 9 pointing to the right at the front of the blade profile can also be easily seen. The blade body 2 is intended to be thin and solid, so that the suction side 8, which is not visible in the drawing, of the profile has a slightly greater convex curvature than the concave curvature of the pressure side 9. Toward the blade root 3, the profiled blade body 2 is defined by a platform 4, which forms the inner wall of the flow passage. On the outside, the flow passage is defined by a shroud band 5, which is integrally connected to the blade tip. Strictly speaking, the reference numeral 5 denotes a shroud-band segment and the actual shroud band is not obtained until the complete blade ring is assembled.

In a radially central region of the blade body 2, there is a rib 10 on the pressure side 9, and the free edge 11 of this rib mostly lies approximately on a line of a pressure side, imaginary, common tangent of a leading edge 6 and a trailing edge 7 of the blade profile. This tangent is indicated as a broken line along the free edge 11 of the rib 10. The rib 10 is to be at least largely neutral with regard to the flow. For example, it is to neither deflect the flow nor induce a relevant additional resistance. In accordance with the flow path to be expected, the rib 10 will be at least mainly oriented axially. The plate-like rib 10 is disposed in an upright position, for example, as far as possible perpendicularly, on the blade surface in order to considerably increase locally the planar moment of inertia of the blade body about the stacking axis Z or about imaginary axes extending parallel to the axis Z, which ultimately influences the mechanical properties of the entire blade.

As already mentioned, there may be one or more ribs on the suction and/or pressure side of the blade body. The free rib contour facing away from the blade body can largely be freely selected, while, of course, taking into account contours which are favorable with regard to the flow. Ribs which extend in a disc-like manner around the entire blade profile are also conceivable, and, in particular, this is for only gently curved profiles, such as, for example, in the case of compressor blades.

Although various minor modifications may be suggested by those versed in the art, it should be understood that I wish to embody within the scope of the patent granted hereon all such modifications as reasonably and properly come within the scope of my contribution to the art.

I claim:

1. A blade with optimized vibration behavior for turbomachinery components in an axial type of construction, said blade being selected from a moving blade and a guide blade for a low-pressure tine region of gas turbines, said blade having a solid, thinly-profiled blade body which is elongated in the direction of a radial stacking axis, said blade having a convex suction side extending between a leading edge and a trailing edge and a concave pressure side extending between the leading and trailing edge, said blade, at a radial distance from both a radially inner blade body end and a radially outer blade body end, having at toast one rib which is disposed in an upright position on a surface of the concave pressure side of the blade body and is oriented in a neutral manner with regard to a local flow path without a relevant angle of incidence to the local flow path, said rib being integrally connected to the blade body and having a free edge extending over most of the length at the rib and approximately along a line extending between the leading and the trailing edges.

2. A blade according to claim 1, where in the blade is a cast design and said rib corresponds to an integral cast contour produced with the blade body.

3. A blade according to claim 1, wherein the blade is a forged design and the at least one rib corresponds to an integral forged contour produced with the blade body.

4. A blade according to claim 1, wherein the free edge of the rib does not extend beyond said line.

* * * * *